US007371031B1

(12) United States Patent
Grimmett

(10) Patent No.: US 7,371,031 B1
(45) **Date of Patent: *May 13, 2008**

(54) SAG CORRECTION SYSTEM

(76) Inventor: James G. Grimmett, 3027 16th Pl., Forest Grove, OR (US) 97116

( * ) Notice: Subject to any disclaimer, the term of this patent is extended or adjusted under 35 U.S.C. 154(b) by 94 days.

This patent is subject to a terminal disclaimer.

(21) Appl. No.: 11/405,793

(22) Filed: Apr. 18, 2006

Related U.S. Application Data

(63) Continuation-in-part of application No. 11/148,115, filed on Jun. 8, 2005, now Pat. No. 7,220,080.

(51) Int. Cl.
*F16L 55/00* (2006.01)

(52) U.S. Cl. ..... 405/184.1; 405/184.4; 138/97

(58) Field of Classification Search .. 405/184.1–184.4; 138/97
See application file for complete search history.

(56) References Cited

U.S. PATENT DOCUMENTS

| | | | | |
|---|---|---|---|---|
| 3,718,978 | A * | 3/1973 | Van Koevering et al. | 405/184.1 |
| 4,309,128 | A * | 1/1982 | Williams | 405/184.3 |
| 4,457,647 | A * | 7/1984 | Dusette et al. | 405/184.1 |
| 4,657,436 | A * | 4/1987 | Yarnell | 405/184.1 |
| 6,588,983 | B1 * | 7/2003 | Tenbusch, II | 405/184.3 |
| 6,619,886 | B1 * | 9/2003 | Harrington | 405/184.2 |
| 6,755,592 | B2 * | 6/2004 | Janssen | 405/184.1 |
| 7,220,080 | B1 * | 5/2007 | Grimmett | 405/184.1 |

* cited by examiner

*Primary Examiner*—Frederick L. Lagman
(74) *Attorney, Agent, or Firm*—Edward P. Dutkiewicz

(57) ABSTRACT

A housing has a central recessed area with a first end and a second end. Each end has an inside rim with at least one aperture there through. The housing has an outside end with an outside end rim with at least one aperture there through. The housing has a central portion with a full circumference. At least one elastomeric pad has an upper face and a lower face. The upper face is coupled to the housing. A compound lifting assembly coupling the pad to the housing.

15 Claims, 8 Drawing Sheets

FIG 3
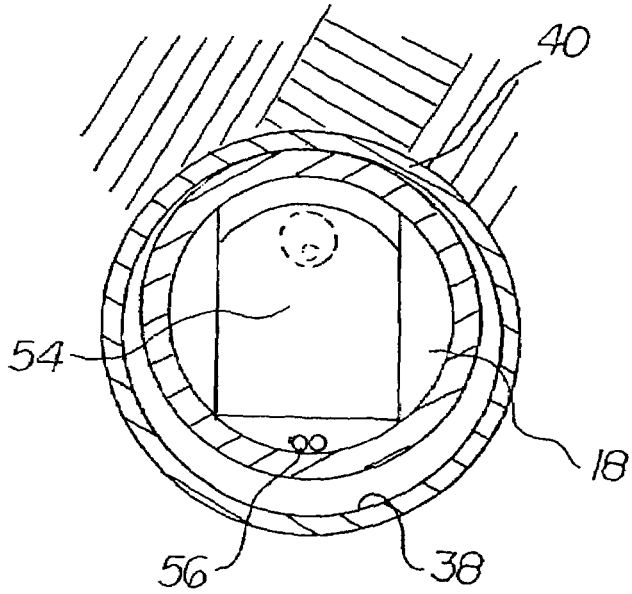
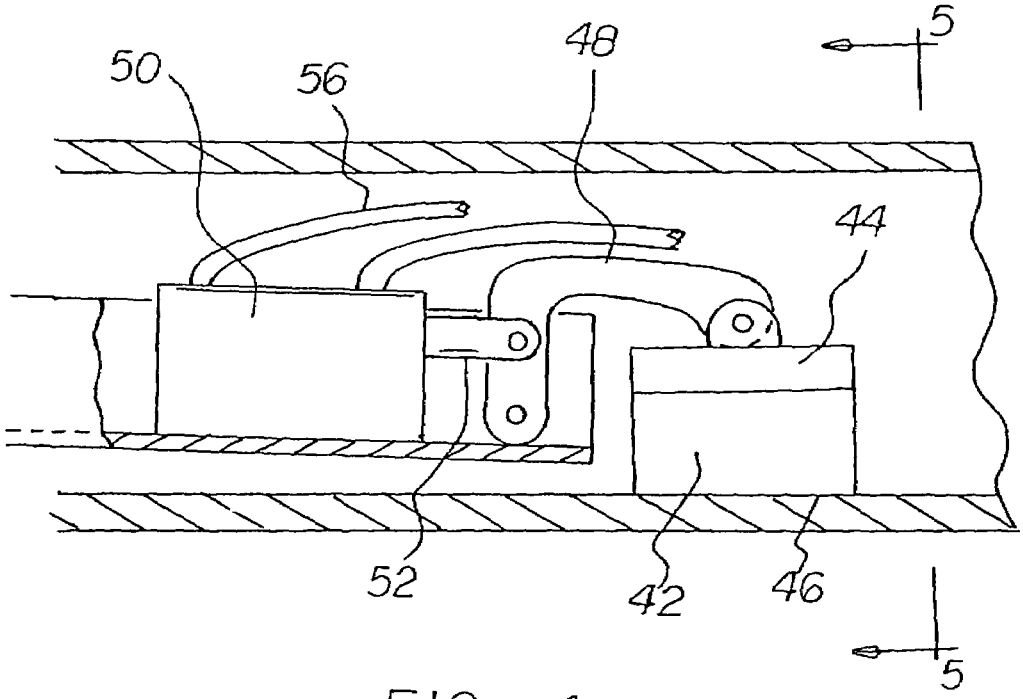
FIG 4

FIG 5
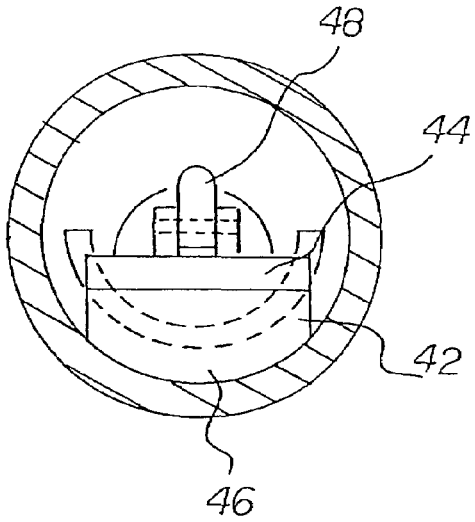
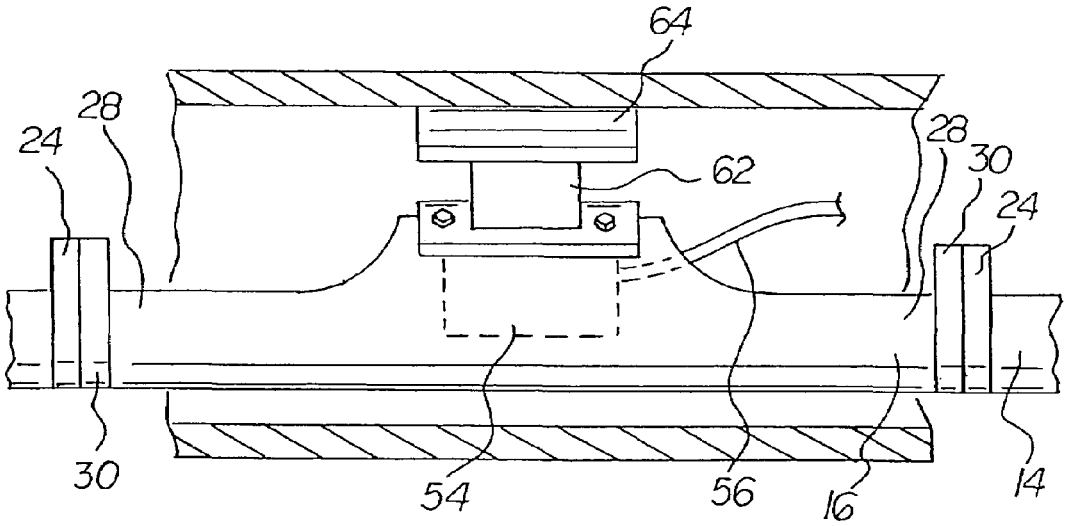
FIG 6

FIG 7
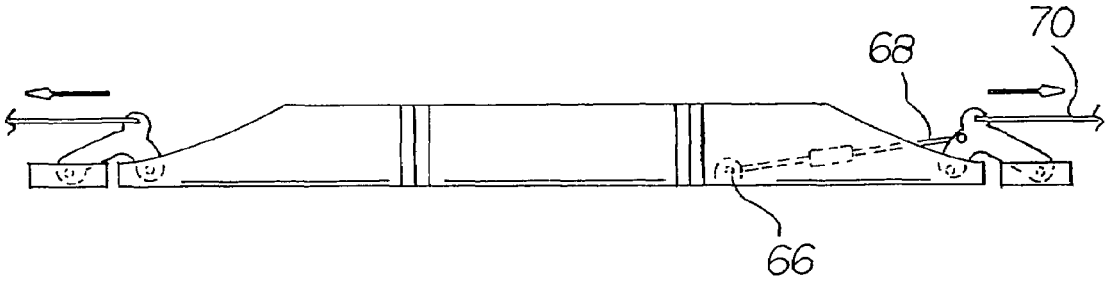
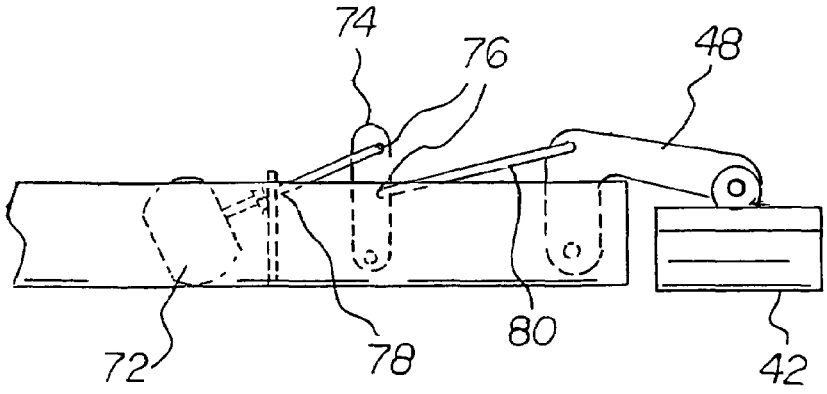
FIG 8

FIG 11
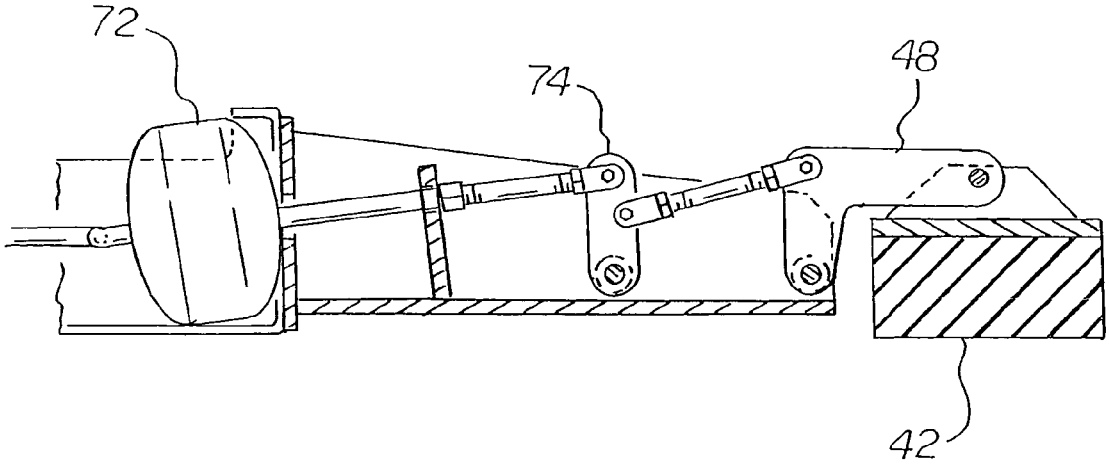
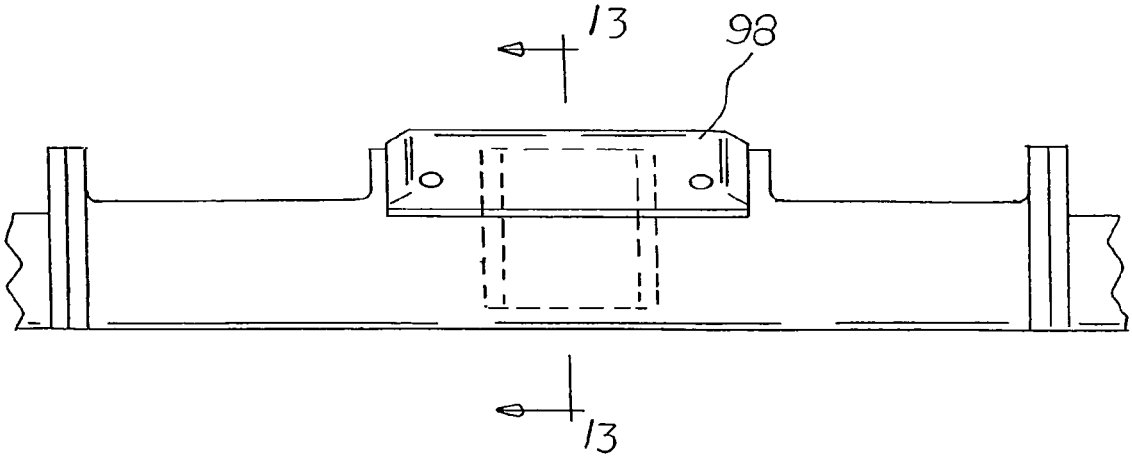
FIG 12

FIG 13
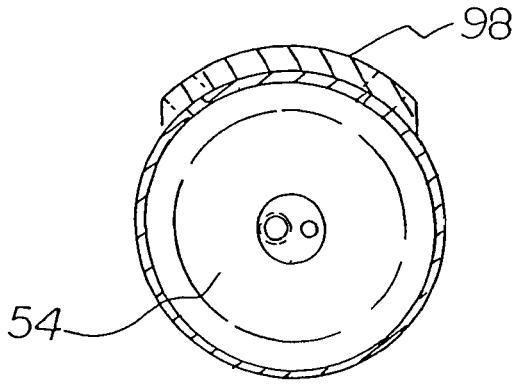
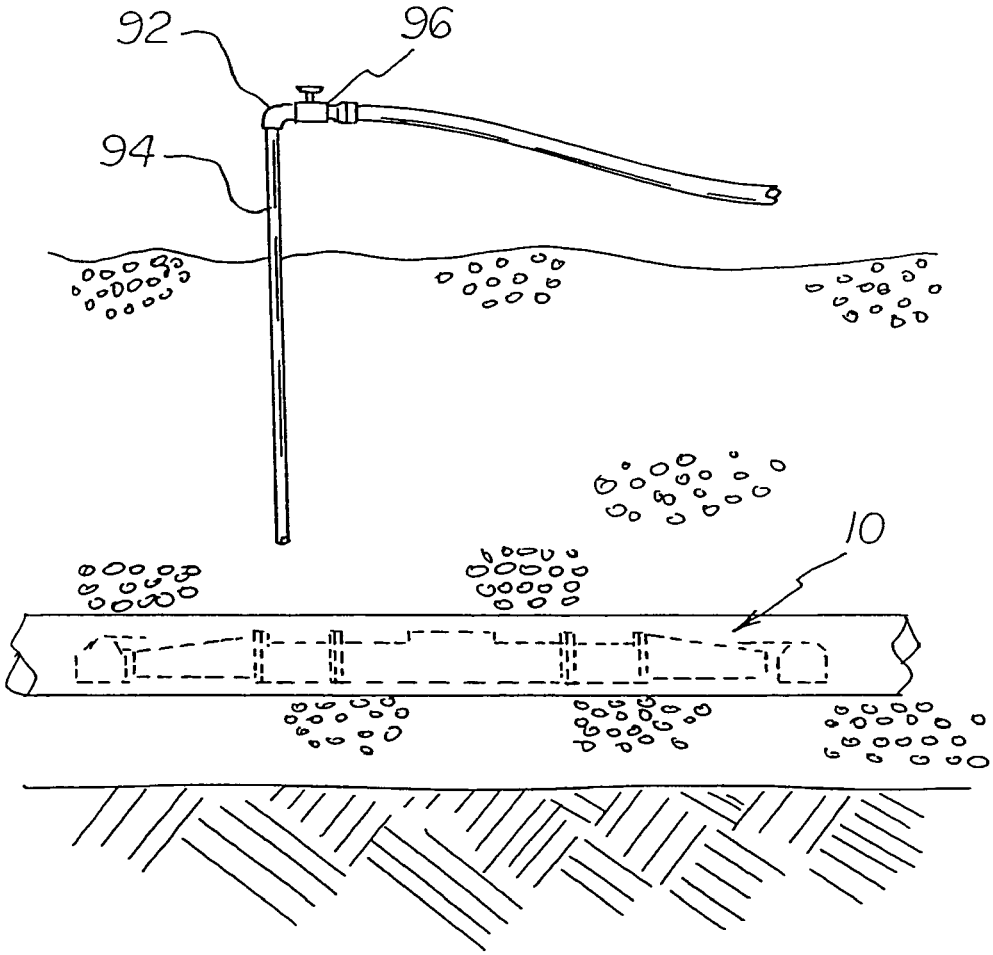
FIG 14

FIG 15
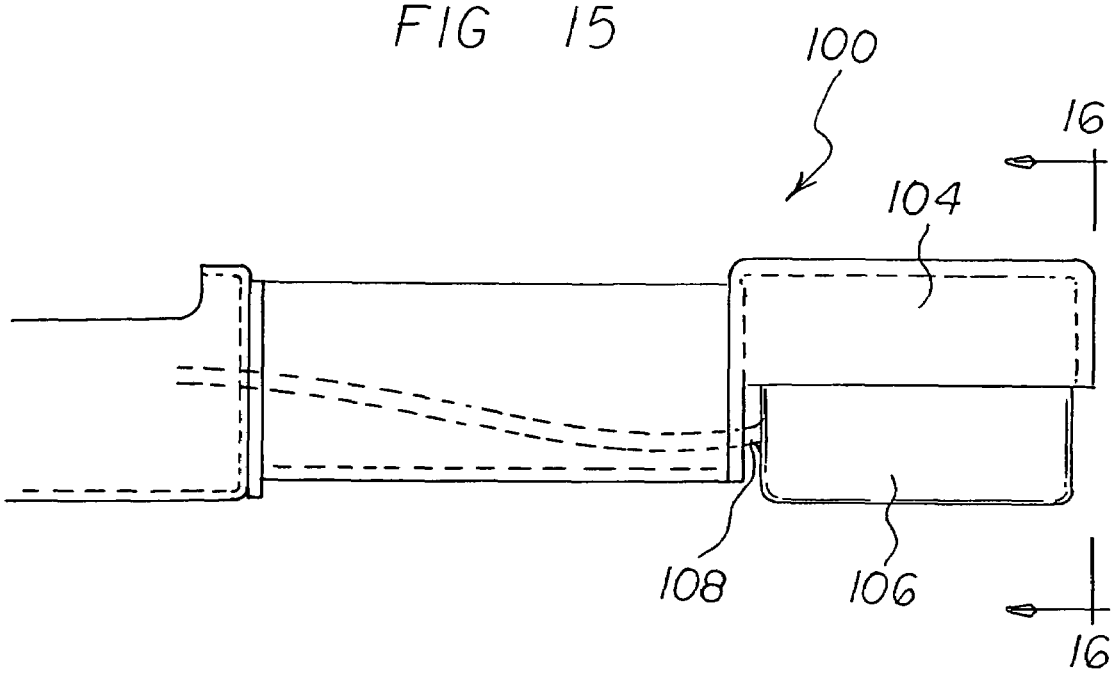
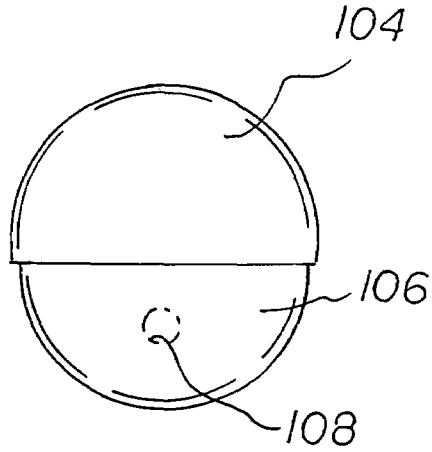
FIG 16

SAG CORRECTION SYSTEM

RELATED APPLICATION

This U.S. patent application is a continuation-in-part of U.S. patent application Ser. No. 11/148,115 filed Jun. 8, 2005, now U.S. Pat. No. 7,220,080 the subject matter of which is incorporated herein by reference.

BACKGROUND OF THE INVENTION

1. Field of the Invention

The present invention relates to a sag correction system and more particularly pertains to eliminating sagging portions of a sewer pipe that occur after installation and extended use.

2. Description of the Prior Art

The use of pipe installation and repair systems of known designs and configurations is known in the prior art. More specifically, pipe installation and repair systems of known designs and configurations previously devised and utilized for the purpose of installing and repairing pipe through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,866,381 issued Jul. 5, 1932 to Ward discloses a Pipe Laying Apparatus. U.S. Pat. No. 5,522,699 issued Jun. 4, 1996 to Smith discloses a Pipe Laying Assembly. U.S. Pat. No. 6,619,886 issued Sep. 16, 2003 to Harrington discloses a System and Method for Installing Formed in Situ Localized Repair of Pipes and Conduits. Lastly, U.S. Pat. No. 6,755,592 to Jun. 29, 2004 to Janssen discloses a Device for Repairing Underground Sewers.

While these devices fulfill their respective, particular objectives and requirements, the aforementioned patents do not describe sag correction system that allows eliminating sagging portions of a sewer pipe that occur after installation and extended use.

In this respect, the sag correction system according to the present invention substantially departs from the conventional concepts and designs of the prior art, and in doing so provides an apparatus primarily developed for the purpose of eliminating sagging portions of a sewer pipe that occur after installation and extended use.

Therefore, it can be appreciated that there exists a continuing need for a new and improved sag correction system which can be used for eliminating sagging portions of a sewer pipe that occur after installation and extended use. In this regard, the present invention substantially fulfills this need.

SUMMARY OF THE INVENTION

In view of the foregoing disadvantages inherent in the known types of pipe installation and repair systems of known designs and configurations now present in the prior art, the present invention provides an improved sag correction system. As such, the general purpose of the present invention, which will be described subsequently in greater detail, is to provide a new and improved sag correction system and method which has all the advantages of the prior art and none of the disadvantages.

To attain this, the present invention essentially comprises a sag correction system. First provided is a generally semi-cylindrical housing. The housing has a first diameter. The housing is fabricated of a rigid material. The housing includes a pair of end sections and a middle section. The end and middle sections have a central recessed area. The end sections have a first outside end and second inside end. The inside ends have an inside rim. A plurality of apertures is provided through the inside rim. The middle section has a pair of equivalent outside ends. Each outside end has an outside end rim. A plurality of apertures are provided through the outside end rim. The apertures are adapted to align with the apertures of the inside rim of the end sections. The middle section has a central portion. The central portion has a full circumference. Bolts are provided. The end sections are adapted to couple to the middle section by the bolts. The bolts provided securement. The bolts are removably positionable in the aligned aperture. In this manner the transportation and assembly within a manhole before placement in the sewer pipe is facilitated.

A sewer pipe is provided. The sewer pipe has a sagging portion. The sewer pipe has a floor and a ceiling. The sewer pipe has a second diameter. The second diameter is greater than the first diameter of the housing.

A pair of elastomeric pads is provided. The elastomeric pads are fabricated of an elastomer. The elastomer is selected from the class of elastomers. The class of elastomers includes plastic and rubber, natural and synthetic, and blends of thereof. Each pad has an upper face and a lower face. The lower face has a semi-cylindrical configuration. The lower face is adapted to fit on the floor of the sewer pipe. The upper face has a hinged coupling. The coupling is adapted to couple the elastomeric pads to the outside ends of the end sections of the housing. The elastomeric pads are adapted to serve as a base for the system to rest upon when activated and held in a resting position. In this manner installation of the housing is facilitated.

Provided next is a pair of air cylinders. The air cylinders function as lifting members. Each air cylinder is positioned in the recessed area of the end sections. Each cylinder has a working arm with a compound lifting assembly coupled to the hinged coupling of the elastomeric pads. The compound lifting assembly includes an air diaphragm and a primary linkage arm followed by an adjustable lever bar with a plurality of apertures followed by a secondary linkage arm and a hinged coupling supporting the pad. The air cylinders are adapted to raise the housing on the elastomeric pads. In this manner the central portion of the middle section is positioned to the top wall of the sewer piper adjacent to the sagging portion. In this manner elevating pressure is applied to the sagging portion.

Further provided is a vibrator. The vibrator is positioned in the central portion of the middle section of the housing. In this manner when the air cylinders are activated and the central portion of the middle section adjacent to the top wall of the ceiling of the sewer pipe, the vibrator produces vibrational energy. The vibrational energy is adapted to be transmitted through the central portion and the sewer pipe and to the surrounding bed or earth. In this manner the pipe is elevated. The vibrational energy is isolated to the area of the sagging portion by the insulating effects of the elastomeric pads.

Provided last is a plurality of control lines, a control unit and a power source. The control lines are adapted to couple the air cylinders and the vibrator to the control unit and the power source.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sag correction system which has all of the advantages of the prior art pipe installation and repair systems of known designs and configurations and none of the disadvantages.

It is another object of the present invention to provide a new and improved sag correction system which may be easily and efficiently manufactured and marketed.

It is further object of the present invention to provide a new and improved sag correction system which is of durable and reliable constructions.

An even further object of the present invention is to provide a new and improved sag correction system which is susceptible of a low cost of manufacture with regard to both materials and labor, and which accordingly is then susceptible of low prices of sale to the consuming public, thereby making such sag correction system economically available to the buying public.

Even still another object of the present invention is to provide a sag correction system for eliminating sagging portions of a sewer pipe that occur after installation and extended use.

Lastly, it is an object of the present invention to provide a new and improved sag correction system. A housing has a central recessed area with a first end and a second end. Each end has an inside rim with at least one aperture there through. The housing has an outside end with an outside end rim with at least one aperture there through. The housing has a central portion with a full circumference. At least one elastomeric pad has an upper face and a lower face. The upper face is coupled to the housing. A compound lifting assembly coupling the pad to the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3-3 of FIG. 1 showing the middle section and vibrator.

FIG. 4 is an enlarged cross sectional view of the present invention taken from circle 4 of FIG. 1 showing an elastomeric pad and cylinder.

FIG. 5 is a cross sectional view taken along line 5-5 of FIG. 4.

FIG. 6 is a cross sectional illustration of an alternative embodiment of the present invention.

FIG. 7 is a cross sectional view of another alternative embodiment of the present invention showing the lifting means being a cable driven.

FIG. 8 is a cross sectional view of yet another alternative embodiment of the present invention showing the lifting means being a driven by an air diaphragm.

FIG. 11 is a cross sectional view taken along line 11-11 of FIG. 10.

FIG. 12 is a side elevational view of the central section of the embodiment shown in FIG. 8.

FIG. 13 is a cross sectional view taken along line 13-13 of FIG. 12.

FIG. 14 is a side elevation of the system illustrated in the prior Figures being used in conjunction with a water injector.

FIG. 15 is a side elevational view of a final alternate embodiment of the invention.

FIG. 16 is an end elevational view taken at line 16-16 of FIG. 15.

The same reference numerals refer to the same parts throughout the various Figures.

DESCRIPTION OF THE PREFERRED EMBODIMENT

Figure 1:
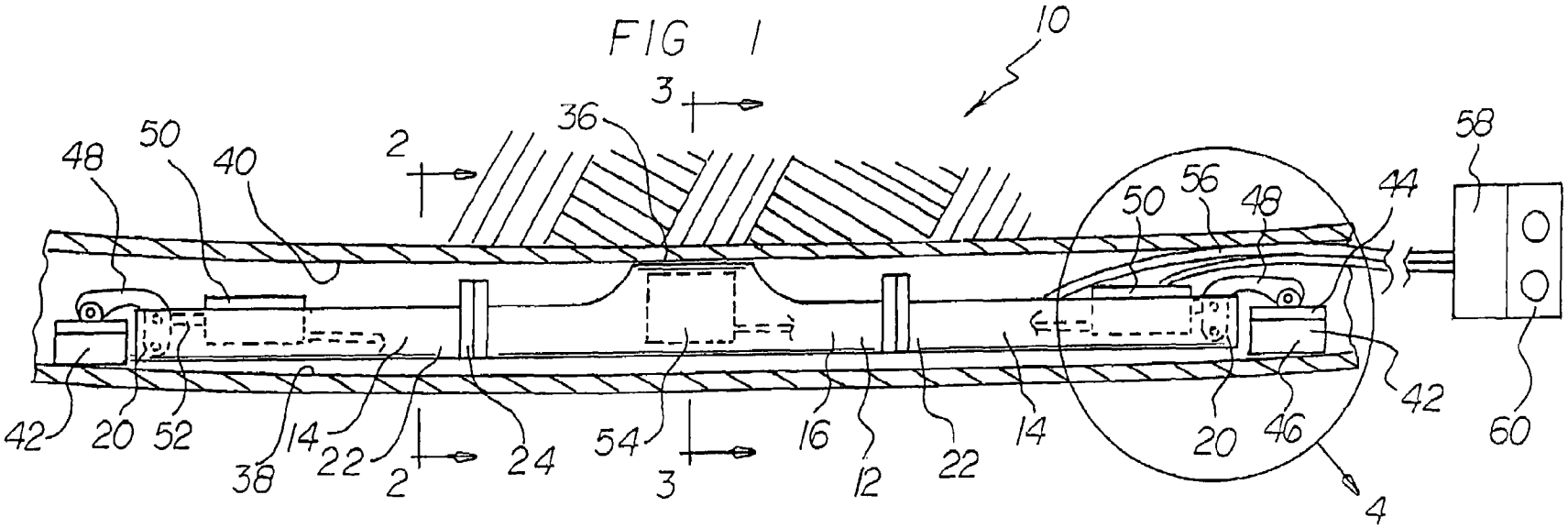
FIG. 1 is a cross sectional illustration of the preferred embodiment of the present invention.
Figure 2:
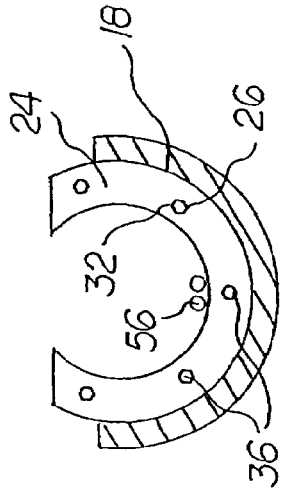
FIG. 2 is a cross sectional view taken along line 2-2 of FIG. 1 showing an end section.
Figure 9:
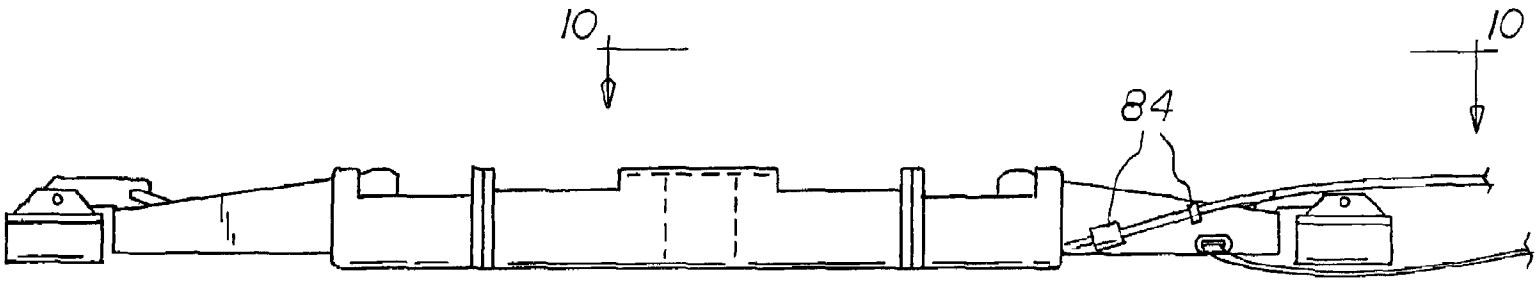
FIG. 9 is a side elevational view of the embodiment shown in FIG. 8.
Figure 10:
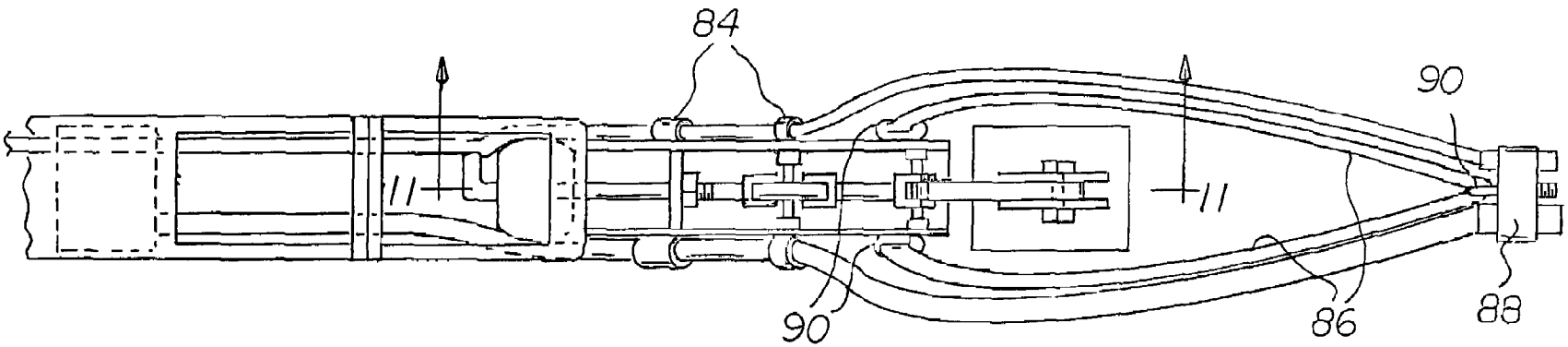
FIG. 10 is a plan view of the embodiment taken along line 10-10 of FIG. 9.

With reference now to the drawings, and in particular to FIG. 1 thereof, the preferred embodiment of the new and improved sag correction system embodying the principles and concepts of the present invention and generally designated by the reference numeral 10 will be described.

The present invention, the sag correction system 10 is comprised of a plurality of components. Such components in their broadest context include a housing, a pair of elastomeric pads and a pair of lifting members. Such components are individually configured and correlated with respect to each other so as to attain the desired objective.

First provided is a generally semi-cylindrical housing 12. The housing has a first diameter. The housing is fabricated of a rigid material. The housing includes a pair of end sections 14 and a middle section 16. The end and middle sections have a central recessed area 18. The end sections have a first outside end 20 and second inside end 22. The inside ends have an inside rim 24. A plurality of apertures 26 is provided through the inside rim. The middle section has a pair of equivalent outside ends 28. Each outside end has an outside end rim 30. A plurality of apertures 32 are provided through the outside end rim. The apertures are adapted to align with the apertures of the inside rim of the end sections. The middle section has a central portion. The central portion has a full circumference. The end sections are adapted to couple to the middle section by bolts 34. The bolts provide securement. The bolts are removably positionable in the aligned aperture. In this manner the transportation and assembly within a manhole before placement in the sewer pipe is facilitated.

A sewer pipe 36 is provided. The sewer pipe has a sagging portion 36. The sewer pipe has a floor 38 and a ceiling 40. The sewer pipe has a second diameter. The second diameter is greater than the first diameter of the housing.

A pair of elastomeric pads 42 is provided. The elastomeric pads are fabricated of an elastomer which is selected from the class of elastomers. The class of elastomers includes plastic and rubber, natural and synthetic, and blends of thereof. Each pad has an upper face 44 and a lower face 46. The lower face has a semi-cylindrical configuration. The lower face is adapted to fit on the floor of the sewer pipe. The upper face has a hinged coupling 48. The coupling is adapted to couple the elastomeric pads to the outside ends of the end sections of the housing. The elastomeric pads are adapted to serve as a base for the system to rest upon when activated and held in a resting position. In this manner installation of the housing is facilitated.

Provided next is a pair of air cylinders 50. The air cylinders function as lifting members. Each air cylinder is positioned in the recessed area of the end sections. Each cylinder has a working arm 52. The working arm is coupled to the hinged coupling of the elastomeric pads. The air cylinders are adapted to raise the housing on the elastomeric pads. In this manner the central portion of the middle section is positioned to the top wall of the sewer piper adjacent to the sagging portion. In this manner elevating pressure is applied to the sagging portion. In the primary embodiment the lifting members are air cylinders. It should be understood that the lifting members could readily be other fluid powered mechanisms such as air powered mechanisms or liquid powered mechanisms.

Further provided is a vibrator 54. The vibrator is positioned in the central portion of the middle section of the housing. In this manner when the air cylinders are activated and the central portion of the middle section adjacent to the top wall of the ceiling of the sewer pipe, the vibrator produces vibrational energy. The vibrational energy is adapted to be transmitted through the central portion and the sewer pipe and to the surrounding earth. In this manner the pipe is elevated. The vibrational energy is isolated to the area of the sagging portion by the insulating effects of the elastomeric pads.

Provided last is a plurality of control lines 56, a control unit 58 and a power source 60. The control lines are adapted to couple the air cylinders and the vibrator to the control unit and the power source.

An alternate embodiment of the present invention may be seen in the embodiment of FIG. 6. The vibrator has an extension arm 62 and a contact pad 64.

Another alternate embodiment of the present invention may be seen in the embodiment of FIG. 7. Each lifting member includes a coupling link 66, a tethering member 68 and a cable 70 whereby the lifting members are cable driven.

The final alternate embodiment of the present invention may be seen in the embodiment of FIG. 8. Each lifting member includes an air diaphragm 72 and an adjustable lever bar 74. Each lifting member includes a plurality of coupling apertures 76 and a pair of linkage arms 78, 80 whereby the lifting members are a driven by the air diaphragm. Such components constitute a compound lifting assembly which includes the air diaphragm 72 and the primary linkage arm 78 followed by an adjustable lever bar 74 with a plurality of apertures 76 followed by a secondary linkage arm 80 and a hinged coupling 48 supporting the pad 42. Fixed rings on the housing provide proper positioning for the control lines.

The sag correction system further includes a pull sling 86 coupled to the housing with a pull block 88 for pulling the system through a sagging sewer pipe. Fixed rings 90 position the sling in proper position on the pull block and the housing.

The sag correction system further includes an injector 92. Such injector is formed of a rigid tube 94 with a lower end insertable into the ground adjacent to a sagging sewer pipe and an upper end with a coupling 96. The coupling is adapted to removably couple with a source of water to introduce a supply of water for loosening the ground there beneath to facilitate sag correction.

Lastly provided is a pad 98 positioned on the top of the central section of the housing. It is removably held in position as by bolts. It functions to provide extra height and support to a sagging pipe being lifted.

A final alternate embodiment of the invention is illustrated in FIGS. 15 and 16. In such embodiment, the system 100 utilizes similarly configured ends, only one of which is shown. Each end of the housing has a rigidly constricted upper support 104 in a half round configuration. Beneath the upper support is a cylindrical shaped inflatable air bag 106. Such air bag is bonded to the upper support. A tube 108 is operatively coupled to each air bag for introducing pressurized air into the air bags for inflation purposes. When inflated, the air bags will enlarge and exert a pressure to the soil below the ends and thereby raise the center of the system to abate any sag as in the prior embodiments. The tube also functions to relieve the air from the air bags when desired.

The sag remover assembles in three sections inside a manhole. It will be necessary to have a channel, approximately 3 feet long, in line with the pipe to be entered, so the sections will align. If the channels are already poured, some chipping of the base may be required.

The sag remover can be installed from either end of the pipe. It needs to be installed so that the hoses are on the upstream side of the sag, otherwise the hoses will block visibility of the sag. Unless the sag is near a manhole, a TV camera will be necessary to check progress.

The weight of the sag remover and the drag from the long hoses makes it difficult to pull by hand. Unless it is a short length of pipe, it is best to have a small winch or light duty pulling device. A pulling winch should be adjusted so the pulling power does not exceed the amount necessary to pull the machine. This helps to prevent the sag remover from getting stuck in the pipe. The pull back line should have considerably more capacity than the pulling winch, in case it does get stuck. Ropes and hoses stretch too much to use for measuring the location of the machine. If using ropes for pulling, a small diameter aircraft type cable can be used with the pull back lines for use as a tape measure.

The sag is lifted by a combination of the lifting force and the centrifugal force of the vibrator. The high frequency vibration allows the granular bedding material to flow from the top to the bottom of the pipe. Distance from the vibrator, the air suspension of the air diaphragm and the isolator pads will reduce the transfer of vibration to the points of downward pressure. The lifting force at the center of the machine, is the sum of the downward force at each isolator pad. This makes the lifting force twice as much as the downward force at each pad. There will be a threshold for the amount of lifting force required to lift the sag. If this amount of force is not greatly exceeded, the downward force at each isolator pad will be under the threshold of force required for movement.

Some types of bedding material will not flow under the pipe when dry. The pipe may lift, but come back down when the lift pressure is released. This will require adding water. See the attached FIG. 14 for a water jet pipe. Once the water is turned on, the jet pipe should be able to be forced into the backfill by hand. If under pavement, access can be obtained by coring holes like those used by testing labs for core samples. The combination of water and vibration of the sag remover can ease resistance by reducing pressure from the backfill on the pipe. We have seen this cause voids above the pipe due to the backfill near the pipe settling, even though the backfill was previously compacted. For this reason, it is a good idea to have a few bags of sand on hand to pour or flush through the hole created by the water jet, to fill any voids.

If the sag is much longer than the span of the sag remover, about 8 feet, it will be necessary to use the arching pad attachment. Note FIGS. 12 and 13. This allows the machine to lift the center of the span above parallel. The longer sags will require moving the machine and lifting the pipe in increments for the length of the sag. After each pass the grade should be checked by filling the sag with water. The length of the sag should diminish with each pass. It usually works good to lift in 4 foot increments, half of the length of the machine. One should go slow and careful until they have experience with this procedure.

Sometimes it is hard to determine what is happening if the sag is unchanged after lift pressure and vibration have been applied. Either the pipe did not move or the pipe was lifted and came back down because the pipe bedding did not flow under the pipe. If the arching pad is used there will be a visible gap between the top of the machine and the pipe, after the lift pressure has been applied. This gap should close when the vibrator is turned on. This indicates the pipe was lifted. Sometimes on a repeated attempt, lift pressure alone may close the gap. This indicates that on the previous attempt, the bedding did not flow under the pipe and it returned down, leaving a void above the pipe.

Water can be poured in from the upper manhole to refill the sag, but this is a slow procedure when the grade is near flat. There is a fitting and low pressure relief valve provided at the hose connections, to connect a small hose for this purpose. The low pressure relief prevents the hose from draining. If no pressurized water is available, a pump up garden sprayer can be used by replacing the wand with a small valve. If working near a manhole, a garden sprayer adjusted to shoot a stream up the pipe works well.

In operation, connect the pull slings to the end sections. Insert the sling halfway through the loop on the machine and connect both ends at the connector link. The slings should fit under the isolator pads as shown m the picture. Connect the hose towing adapter to the sling and the machine hoses as shown in the picture. The air filter and oiler assembly are required and should connect to the compressor side of the hose towing adapter. The hose towing adapter transfers the drag of the hoses evenly to the pull slings and keeps slack in the hoses at the machine. If the hoses are allowed to pull directly on the machine they may roll it off-vertical in the pipe. Twists in pull cables or ropes should be removed to prevent rolling the machine in the pipe. The use of braided rope would be preferred over twisted strand rope. The machine is designed bottom heavy to self upright. If it is out of vertical when positioned, try pulling it back and forth to bring it upright. The machine seems to be better at staying vertical when the arching pad is installed.

Assemble the machine in the manhole with the hose end upstream. Connect the pull line to the first section and start it in the pipe. Keep the slack pulled out of the sling so that it does not wad up or tangle. If entering from the lower manhole, it will be necessary to first pull the hoses through the pipe and connect them. Connect the main sections using the large bolts. The use of an air ratchet will greatly speed up tightening the locknuts. Use two large end wrenches to get the bolts as tight as possible. Connect the compression fittings for the lift circuit air lines. These fittings should be tightened snug. If they are tightened too tight they will be hard to disconnect. A drop of 242 Loctite on the male threads should keep them from loosening. There is a sleeve in the hose under the compression ring. When disconnecting, the sleeve may stay in either the hose or the fitting. Make sure it is in place before reconnecting. Keep all of the hose ends plugged when no connected, especially on the hoses between the air filter and the vibrator. Dirt or debris entering the vibrator can make the internal vane sticky and keep it from starting.

In tight manholes with a lack of channel length, it may be necessary to connect the lift circuit hose to the first section before positioning and connecting the middle section. If desired an extension hose for the first section can be made using the double ended compression fitting in the spare parts kit. For tight manholes there will be more room to connect the vibrator hose if the machine enters from the upstream manhole. Additional room can be obtained for the last end section by disconnecting the lift lever clevis and flipping the isolation pad vertical or removing the pad at the hinge bolt.

Whenever pulling the sag remover from the hose end, be sure to keep the slack pulled out of all of the hoses. If not, one or more of the hoses can wad up at the end of the machine and bind it in the pipe.

After the machine is in position, apply lift pressure before turning on the vibrator. Maximum lift pressure is 140 psi. The amount of lift pressure required will vary with conditions. Some sags may only require about 30 psi. It is best to only use as much pressure as necessary. Less pressure will reduce the chance of affecting the grade at the isolator pads and place less stress on pipe and fittings. One minute or less of vibration is usually adequate. Do not run the vibrator unless lift pressure is applied. Without life pressure applied, torque from the vibrator can roll the machine in the pipe. The is more likely to develop problems caused by resonance frequency when it is not under lift tension and unnecessary vibration adds wear to the loose lift linkage.

The geometry of the lift levers causes the isolator pads to travel outward as they move down The pads slide on the PVC pipe and deflect when on rough surfaces. We have not seen any horizontal movement of the pipe, but it is something to keep in mind if working near wide joints. Placing the pads on pints and fittings should be avoided if possible.

With regard to maintenance, the air line for the front lift goes through the exhaust port in the vibrator. This line should be regularly checked for wear and replaced as necessary. Do not install any wear sleeves or grommets in the exhaust port, because this would restrict the air flow and cause poor performance. The lift circuit air lines and fittings are standard DOT equipment for trucks and should be available at truck parts stores and at some auto parts stores.

The large nylon insert lock nuts for the main assembly bolts will need to be replaced often. We recommend replacing them for every job. The other alternatives would be jam nuts or Loctite.

Fill the in-line oiler with Dexron ATF. The oil level should be checked through the sight glass before each use. The air filter has a cleanable fine mesh screen. It should be inspected occasionally and cleaned as required.

After each use a small amount, about half of an ounce or so, of ATF should be run through the vibrator and the machine should be stored in a dry place to prevent internal rust. Precautions should be taken to keep all air supply lines clean. Any internal rust or dirt can make the vane in the vibrator sticky and keep it from starting. If the machine has been setting for any length of time, connect air to the center section only and check to make sure that it will start every time before assembling in a manhole. If not, running it and adding oil to flush it out, will usually free it up. The vibrator must be in the vertical position to check it. If it is beyond 75 degrees of being vertical in either direction it may not start due to positioning of the internal vane. If the vane gets stuck and the vibrator will not start, it could require striking against the ground to get it to start.

Before each use inspect the machine for loose bolts and fittings, and worn or broken parts.

Air supply air requirements are 70 cfm at 80 to 100 psi. Long lengths of hose are very restrictive. A higher pressure at the compressor will be required due to pressure drop caused by the long lengths of hose. The air hose diameter required to achieve the necessary flow will be ¾ to 1 inch. Shut off type couplings should not be used because of air restriction.

To test the air supply, connect a gauge to the inlet hose on the center section of the sag remover using a tee. Connect the oiler and air filter assembly to the tee. Connect the full amount of hose to be used between the compressor and the oiler-filter assembly. Check the back pressure at the gauge with the vibrator running. The gauge must be located at the vibrator and the vibrator must be running. The ideal operating pressure is 80 to 90 psi. Operating pressure can be increased by increasing the pressure at the compressor, reducing the length of the hose, or increasing the diameter of the hose for part of the distance.

Canister type air line oilers that are mounted on some compressors are too far away to provide lubrication. Many of these are too restrictive and have to be removed to get enough air flow.

In addition to the basic safety rules for working around sewer manholes and pipe, there are some important ones for this process. First, be sure to disable any pulling device and keep personnel away from the pulling ropes when assembling the machine in the manhole. End plates and access cut outs of the machine entering the pipe can work like a shear, causing serious injury. Block the machine from accidental movement whenever possible. Additionally, disconnect the air supply before working near the moving parts of the lift mechanism. Keep hands away from these parts when the air is connected.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sag correction system comprising:

a housing having a central recessed area with a first end and second end with each end having an inside rim with at least one aperture there through, the housing having an outside end with an outside end rim with at least one aperture there through, the housing having a central portion with a full circumference;

at least one elastomeric pad with the pad having an upper face and a lower face, the upper face being coupled to the housing; and a compound lifting assembly coupling the pad to the housing.

2. The sag correction system as set forth in claim 1 wherein the lower face of the elastomeric pad is shaped in a semi cylindrical configuration and adapted to fit on the floor of a sagging sewer pipe.

3. The sag correction system as set forth in claim 1 and further including at least one control line being adapted to couple the lifting member to a control unit and a power source.

4. The sag correction system as set forth in claim 1 wherein the lifting member is a fluid powered.

5. The system as set forth in claim 4 wherein the lifting member is air powered.

6. The system as set forth in claim 4 wherein the lifting member is liquid powered.

7. The sag correction system as set forth in claim 1 and further including a vibrator positioned within the housing.

8. The sag correction system as set forth in claim 1 wherein the vibrator has an extension arm and a contact pad.

9. The sag correction system as set forth in claim 1 wherein the lifting member includes a coupling link and a tethering member and a cable.

10. The sag correction system as set forth in claim 1 wherein the lifting member includes an air diaphragm and an adjustable lever bar with a plurality of coupling apertures and a pair of linkage arms.

11. The sag correction system as set forth in claim 1 and further including a pull sling coupled to the housing with a pull block for pulling the system through a sagging sewer pipe.

12. The sag correction system as set forth in claim 1 and further including an injector formed of a rigid tube with a lower end insertable into the ground adjacent to a sagging sewer pipe and an upper end with a coupling adapted to introduce a supply of water to loosen the ground there beneath to facilitate sag correction.

13. The sag correction system as set forth in claim 1 and further including:

an arching pad on an upper surface of the housing at a central extent thereof.

14. The system as set forth in claim 1 wherein each end of the housing has a rigidly constricted upper support in a half round configuration and a cylindrical shaped inflatable air bag there beneath bonded to the upper support with a tube operatively coupled to each air bag for introducing pressurized air into the air bags for inflation purposes.

15. A sag correction system for eliminating sagging portions of a sewer pipe that occur after installation and extended use comprising, in combination:

a generally semi-cylindrical housing with a first diameter and fabricated of a rigid material, the housing including a pair of end sections and a middle section all having a central recessed area, the end sections having a first outside end and second inside end with the inside ends having an inside rim with a plurality of apertures there through, the middle section having a pair of equivalent outside ends each with an outside end rim and a plurality of apertures adapted to align with the apertures of the inside rim of the end sections, the middle section having a central portion having a full circumference, the end sections being adapted to couple to the middle section by bolts for securement purposes, the bolts being removably positionable in the aligned aperture to facilitate the transportation and assembly within a manhole before placement in a sewer pipe which has a sagging portion as well as a floor and a ceiling, the sewer pipe having a second diameter with the second diameter being greater than the first diameter of the housing;

a pair of elastomeric pads with each pad having a upper face and a lower face with the lower face having a semi-cylindrical configuration and adapted to fit on the floor of the sewer pipe, the upper face having a hinged coupling adapted to couple the elastomeric pads to the outside ends of the end sections of the housing, the elastomeric pads being adapted serve as a base for the system to rest upon when activated and held in a resting position to facilitate installation of the housing;

a pair of air cylinders functioning as lifting members, each being positioned in the recessed area of the end sections and having a working arm with a compound lifting assembly coupled to the hinged coupling of the elastomeric pads, the compound lifting assembly including an air diaphragm and a primary linkage arm followed by an adjustable lever bar with a plurality of apertures followed by a secondary linkage arm and a hinged coupling supporting the pad, the air cylinders being adapted to raise the housing on the elastomeric pads thereby positioning the central portion of the middle section to the top wall of the sewer piper adjacent to the sagging portion and thereby applying elevating pressure to the sagging portion;

a vibrator positioned in the central portion of the middle section of the housing such that when the air cylinders are activated and the central portion of the middle section adjacent to the top wall of the ceiling of the sewer pipe, the vibrator will produce vibrational energy adapted to be transmitted through the central portion and the sewer pipe and to the surrounding earth to facilitate the elevation of the pipe, the vibrational energy being isolated to the area of the sagging portion by the insulating effects of the elastomeric pads; and a plurality of control lines adapted to couple the air cylinders and the vibrator to a control unit and a power source;

a pull sling coupled to the housing with a pull block for pulling the system through a sagging sewer pipe; and an injector formed of a rigid tube with a lower end insertable into the ground adjacent to a sagging sewer pipe and an upper end with a coupling adapted to introduce a supply of water to loosen the ground there beneath to facilitate sag correction and an arching pad on an upper surface of the housing at a central extent thereof.

* * * * *